United States Patent [19]

Davis

[11] Patent Number: 5,031,558

[45] Date of Patent: Jul. 16, 1991

[54] LIQUID CARGO TANKER

[76] Inventor: Sanford Davis, 8797 Ira Rd., Fair Haven, Mich. 48023

[21] Appl. No.: 434,285

[22] Filed: Nov. 13, 1989

[51] Int. Cl.[5] ..... B63B 25/08

[52] U.S. Cl. ..... 114/74 R; 114/72

[58] Field of Search ..... 114/72, 73, 74 R, 74 A, 114/74 T; 280/837, 838; 220/403, 410, 413, 470, 5 a, 900, 901, 1 B

[56] References Cited

U.S. PATENT DOCUMENTS

| | | | |
|---|---|---|---|
| 1,835,645 | 12/1931 | Hague | 114/74 R |
| 2,724,418 | 11/1955 | Krupp | 220/1 B |
| 3,356,251 | 12/1967 | Roberts | 114/74 R |
| 3,385,251 | 5/1968 | Grocott | 114/74 R |
| 3,906,880 | 9/1975 | Hebert | 114/74 R |
| 3,922,985 | 12/1975 | Hamilton | 114/74 R |
| 4,729,570 | 3/1988 | Welch, Jr. | 280/837 |

FOREIGN PATENT DOCUMENTS

| | | | |
|---|---|---|---|
| 0030900 | 6/1981 | European Pat. Off. | 114/74 R |
| 2333700 | 8/1977 | France | 114/74 R |
| 2017011 | 9/1979 | United Kingdom | 114/74 R |

*Primary Examiner*—Ed Swinehart

*Attorney, Agent, or Firm*—Reising, Ethington, Barnard Perry & Milton

[57] ABSTRACT

A liquid cargo tanker (10) includes a liquid carrying hold (18,20,22) and a reservoir (24) disposed within the hold (18,20,22) for containing a liquid to be transported therein. The reservoir (24) includes a top wall (26) and a bottom wall (28), both walls having edge portions in fluid tight engagement defining a fluid tight seam (30). The top wall (26), bottom wall (28) and seam (30) are free from connection to the hold (18,20,22). The reservoir (24) has a full condition wherein the top wall (26) is raised by the liquid away from the bottom wall (28) as the seam (30) moves away from the hold (18,20,22) and an empty condition wherein the top wall (26) collapses on the bottom wall (28) as the seam (30) moves towards the hold (18,20,22).

10 Claims, 1 Drawing Sheet

LIQUID CARGO TANKER

TECHNICAL FIELD

The present invention relates generally to sea going vessels whose hulls define a liquid carrying hold for transporting liquids therein. More specifically, the present invention relates to a tanker type ship that can withstand damage to the ship hull while maintaining fluid tight integrity of the fuel reservoir within the ship.

BACKGROUND ART

Tanker ships, such as fuel tankers, are used to transport various liquids in the open sea. Damage to the ship's hull, such as by running aground, can cause damage to the hull. If the hull defines the fuel reservoir of the tanker, damage to the hull can result in fuel spillage and ultimately environmental disaster.

The U.S. Pat. No. 3,84,239 to McLaughlin et al, issued Oct. 29, 1974 and U.S. Pat. No. 4,230,061 to Roberts et al, issued Oct. 28, 1980 address the problem of spillage of liquids from sea going vessels. Both patents provide a cargo container including an inner bladder. The McLaughlin et al patent provides a resilient lining for a reservoir adapted to separate from the walls of at least one of the reservoirs upon a predetermined minimum external concussive pressure and deformation of the walls of the reservoir. The lining is adapted to stretch upon the pressure and deformation and force the liquid contained therein to flow through an ejecting piping system and towards an empty space. The patent provides several methods of releasably securing the lining about the entire wall of the reservoir.

The Roberts et al patent discloses a double tank shipping container including a flexible bladder forming an inner tank received within an outer tank and readily removable therefrom. The inner tank has a configuration roughly conforming to the contours of the outer tank and is fixedly secured to the neck portion of the closed outer tank.

Neither prior art patent discussed above provides a resilient container completely independent structurally of the supporting hull. Further, the prior art does not disclose a liner that can be retrofitted into existing liquid carrying tankers with minimal restructuring of the hulls.

SUMMARY OF THE INVENTION

In accordance with the present invention there is provided a liquid cargo tanker including a liquid carrying hold and reservoir means disposed within the hold for containing a liquid to be transported therein. The reservoir means includes a top wall and a bottom wall having edge portions in fluid type engagement defining a fluid tight seam. The top wall, bottom wall, and seam are free from connections to the hold. The reservoir means has an empty condition wherein the top wall is raised by the fluid contained therein away from the bottom wall as the seam moves away relative to the hold and an empty condition wherein the top wall collapses on the bottom wall as the seam moves towards the hold.

FIGURES IN THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

A liquid cargo tanker constructed in accordance with the present invention is generally shown at 10 in the Figures. The tanker 10 can include a cabin section 12, a mast 14 and a hull 16 Of course, such tankers and ships can include various other specific structures.

Figure 1:
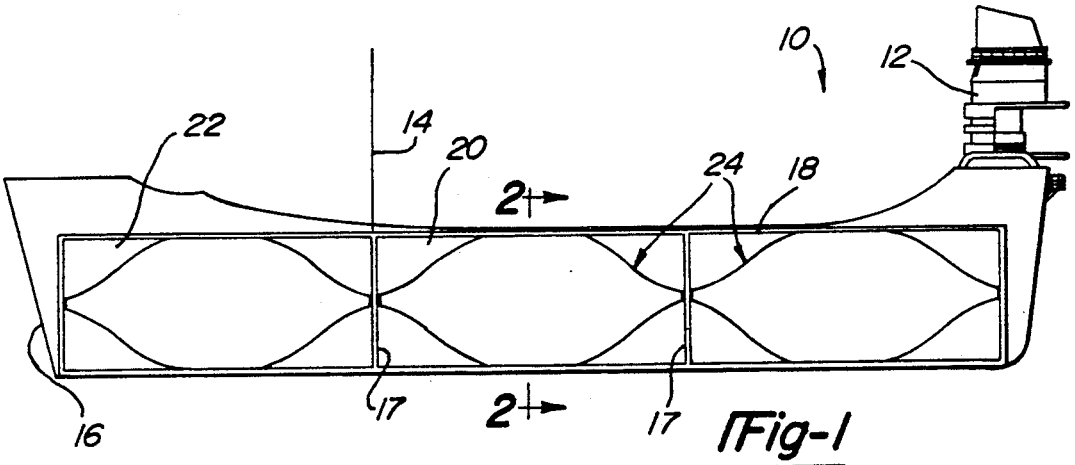
FIG. 1 is a cross sectional view of a liquid cargo tanker made in accordance with the present invention.

The hull 16 is divided by structural partitions 17 into a plurality of liquid carrying holds 18,20,22 as shown in FIG. 1. The holds can also have a divider extending longitudinally of the ship as shown in cross section in FIG. 2 dividing hold 20 into holds **20*a* and 20*b*. Each hold is chamber defined by the partitions 17 forming side walls of the chamber and the hull 16 forming a bottom wall and other side wall of the chamber. The hull 16 and chambers 18,20,22 can be found in existing liquid cargo tankers. Alternatively, the tanker may not include partitions 17 but rather a single large hold defined by the open hull 16**.

Each hold 18,20,22 contains a reservoir 24 for containing a liquid to be transported therein. Generally, the reservoir 24 includes a resilient top wall 26 and bottom wall 28. The top wall 26 and bottom wall 28 have edge portions in fluid tight engagement defining a fluid tight seam 28. The top wall 26, bottom wall 28 and seam 30 are free from connection to the hold 18,20,22 which contains the respective reservoir. That is, there is no connection between the reservoir 24 and hold 18,20,22. Rather, the reservoir 24 is seated such that the bottom wall 28 of each reservoir 24 lays on the floor of the hold 18,20,22 as defined by the hull 16 or other support structure, such as a floor, which may be constructed in each hold 18,20,22.

Figure 2:
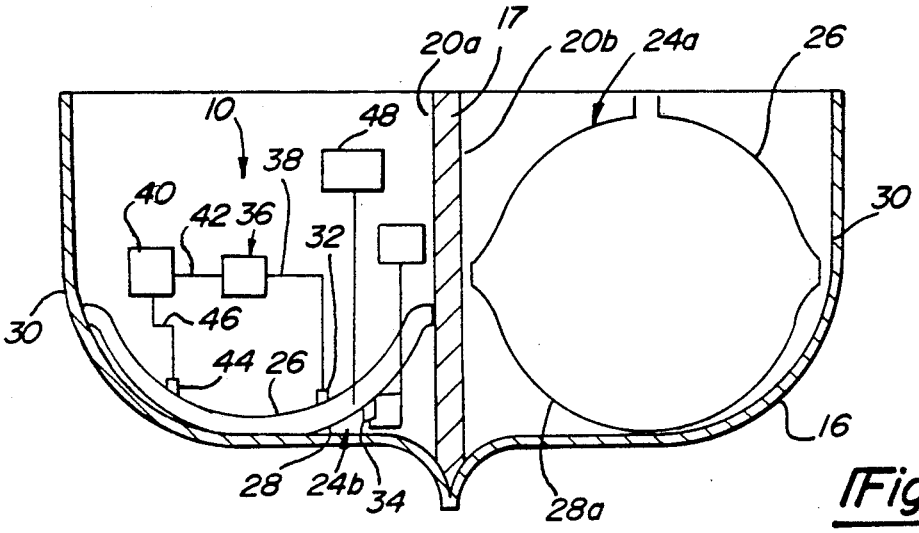
FIG. 2 is a cross sectional view of the liquid cargo tanker showing the reservoirs in a full and empty condition.

As shown in FIG. 2, the reservoir labeled **24*a* has a full condition wherein the top wall 26 is raised by the fluid contained therein away from the bottom wall 28*a* as the seam 30 moves away from the hold 16 and an empty condition, as shown at 24*b* in FIG. 2, wherein the top wall 26 collapses on the bottom wall 28 as the seam 30 moves towards the hold 16. In other words, in the empty condition, the top wall 26 lays directly on the bottom wall 28, the seam 30 being disposed substantially adjacent the hold 16. As the reservoir 24*a* is filled, the top wall 26 separates from and rises above the bottom wall 28. The reservoir 24*a* balloons such that the seam 30** moves away from the wall defined by the hold.

As shown schematically in FIG. 2, the reservoir 24 includes a fluid inlet 32 through the top wall 26 and a fluid outlet 34 through the bottom wall 28. Of course, the reservoir 24 can take on various configurations and be connected to various pumping mechanisms for pumping fluid into and out of the reservoir.

If the tanker 10 is used to carry volatile liquids, such as oil, and the reservoir 24 is not completely filled, the liquid will release volatiles into the air within the reservoir 24. The tanker 10 includes venting means schematically generally shown at 36 in FIG. 2 for venting volatiles from the reservoir 24. More specifically, the venting mechanism 36 would consist of a blower 36 in fluid communication with the reservoir 24 for drawing the volatiles out of the reservoir 24 periodically. A conduit 38 operatively connects the blower 36 to the reservoir 24. A condenser 40 is operatively connected to the blower mechanism 36 by conduit 42 and then to a second inlet 44 of the reservoir 24 by conduit 46 for condensing the volatiles drawn from the reservoir 24 by the blower 36 and returning the condensed volatiles back to the reservoir 24. Thusly, the blower 36 and reservoir 40 is in a closed circuit with the reservoir 24 for drawing off volatiles, condensing the volatiles back to the liquid state, and then returning the liquid back to the reservoir 24. A pump may be needed to draw the liquid from the condenser 40 and return it back to the reservoir although a gravity flow system may also be used.

The reservoir 24 may include a fuel sensor, schematically shown at 48 in FIG. 2, operatively connected to the reservoir 24 for sensing the amount of liquid in each tank. The fuel sensor 48 can be an electronic sensor providing information regarding the amount of fuel contained within the tank.

Additionally, the tanker 10 will include flow controls between the reservoir 24 for regulating the flow to and from each of the reservoirs 24 simultaneously. Valving will be used to load or draw from a single reservoir 24 or multiple reservoirs 24 to mix or isolate the contents of each reservoir 24. For example, the liquid may be drawn from a single reservoir 24, or simultaneously from several reservoirs 24. Therefore, the tanker 10 will include mechanical and electronic controls of the flow of liquid to and from the reservoirs 24.

Figure 3:
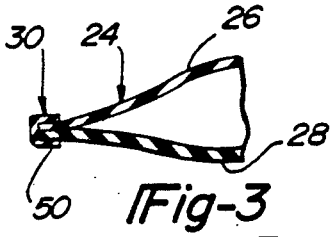
FIG. 3 is an enlarged cross sectional view of a seam of the reservoir.
Figure 4:
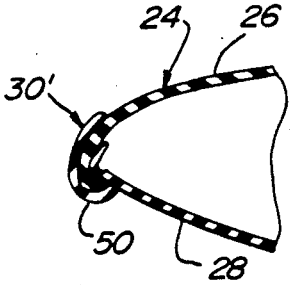
FIG. 4 is an enlarged cross sectional view of a second embodiment of the seam of the reservoir.

As shown in FIG. 3, the seam 30 can take the form of a butt-seam wherein the edges of the top wall 26 and bottom wall 28 form a layer interconnected by an outer seam material 50. An adhesive can be used to interconnect the top and bottom wall edges with the outer tape layer 50. Alternatively, as indicated at 30, in FIG. 4, a seam may be an overlap seam wherein the edges of the top and bottom walls 26,28 overlap each other and are also joined by a tape 50. This seam may also be glued. Either embodiment of the seam may otherwise be bonded or welded to form a fluid tight seal. Other adhesives or sealant materials can also be applied to the inner aspect of the seams within the tanks as long as the adhesive or other material used is not soluble in the liquid to be contained within the tank.

Figure 5:
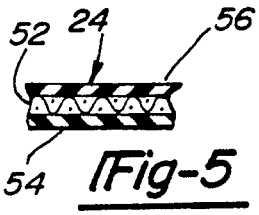
FIG. 5 is a further enlarged cross fragmentary cross sectional view of the reservoir material.
Figure 6:
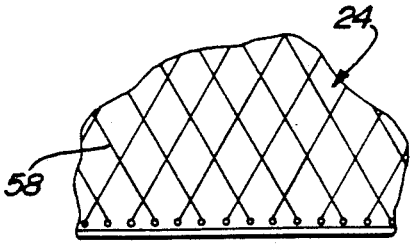
FIG. 6 is a fragmentary cross sectional view of a second embodiment of the material of the reservoir.

FIG. 5 shows an enlarged cross sectional view of the material used for the top and bottom walls 26,28. The walls 26,28 consist essentially of a woven material 52 having a fluid impervious rubber coating on each side thereof. The material can be a woven nylon fabric having high tenacity and heat and light resistance, coated on both sides with a rubber or rubber like coating having resistance to many different fuels for storage therein.

Alternatively, each reservoir 24 can include an outer supporting web 58 disposed over the reservoir 24 for providing additional support to the top and bottom walls 26,28. The web 58 can be a lattice like structure supporting the resilient reservoir 24 to reduce the probability that a tear in the hull will result at the same time in damage to the reservoirs 24. The lattice like structure can be designed to slide away from any penetrating materials. Thusly, collapsible reservoirs 24 will retain their integrity. The lattice like structures can be made from various types of nylons or Teflon coated cables. The web 58 further provides position structural support to prevent rolling or otherwise movement of the reservoirs 24 caused by sudden inerted shifts in the liquid contained within each reservoir 24. This is accomplished by the web 58 having limited elasticity in order to absorb a significant portion of the forces occurring when there is a sudden shift in the liquid in the reservoir 24, such as when the tanker 10 travels or sharply turns.

The general sizes of the reservoirs may run from 20,000 gallons to 50,000 gallons and as large as 210,000 gallons. In flat state, such a reservoir would be 68 feet by 68 feet approximately.

A typical collapsible tank could be 24 feet by 28 feet and hold about 20,000 gallons of fuel. Tanks can be made over a wide range of sizes, including those with several times the fuel holding capacity of the aforementioned tank. Such tanks would be designed to have an over fill capacity by as much as 10%.

Thus, the present invention provides a resilient reservoir 24 that can withstand a distortion in a ship's hull due to an impact thereto by distorting its periphery while maintaining its integrety. By being completely structurally independent of its hold, the reservoir 24 merely gives way to intrusions by any damage to the ship's hull. Advantageously, the reservoir of the present invention can be placed in existing ship hulls of tankers and function as described herein, thereby providing a cost effective means of improving the means for shipping fuels on the high seas.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A liquid cargo tanker (10) comprising a liquid carrying hold (18,20,22) and reservoir means (24) disposed within said hold (18,20,22) for containing a liquid to be transported therein, said reservoir means (24) including a top wall (26) and a bottom wall (28) having edge portions in fluid tight engagement defining a fluid tight seam (30), said top wall (26), bottom wall (28) and seam (30) being free from connection to said hold (18,20,22), said reservoir means (24) having a full condition wherein said top wall (26) is raised by the liquid away from said bottom wall (28) as said seam (30) moves away from said hold (18,20,22) and an empty condition wherein said top wall (26) collapses on said bottom wall (28) as said seam (30) moves towards said hold (18,20,22), the liquid in said reservoir means being a volatile liquid, said tanker (10) further including venting means (36) for venting volatiles from within said reservoir means (24), and inertial flow control means including a supporting web disposed over and being in engagement with said reservoir (24) for absorbing forces occurring within said reservoir (24) when there is a sudden inertial shift in the liquid within said reservoir (24).

2. A tanker as set forth in claim 1 wherein said reservoir means (24) includes a fluid inlet (32) through said top wall and a fluid outlet through said bottom wall (28).

3. A tanker as set forth in claim 1 wherein said venting means includes blower means (36) in fluid communication with said reservoir means (24) for drawing volatiles out of said reservoir means (24), said tanker including conduit means (38) operatively connecting said blower means to said reservoir means.

4. A tanker as set forth in claim 3 further including condenser means in fluid communication between said blower means and said reservoir means for condensing the volatiles drawn from said reservoir means (24) by said blower means (36) and returning the condensed volatiles to said reservoir means (24).

5. A tanker as set forth in claim 1 further including fuel sensor means (48) operatively connected to said reservoir means (24) for sensing the amount of the liquid in said reservoir means (24).

6. A tanker as set forth in claim 1 wherein each of said top and bottom walls (26,28) consist essentially of a woven material having a fluid impervious rubber coating on each side thereof.

7. A tanker as set forth in claim 6 wherein said woven material (52) is a woven nylon fabric.

8. A tanker as set forth in claim 1 wherein said reservoir (24) further includes a supporting web (58) disposed over said reservoir means (24) for providing additional support to said top and bottom walls (26,28).

9. A tanker as set forth in claim 1 wherein said tanker (10) includes a plurality of said reservoir means (24), said tanker (10) further including flow sensor means for regulating the flow to and from each of said reservoir means simultaneously 10. A reservoir (24) for containing liquid therein for transport in a vehicle, said reservoir (24) comprising: a top wall (26); a bottom wall (28) having edge portions in fluid tight engagement defining a fluid tight seam (30) for holding liquid therein while being free from connection to the vehicle: inertial flow control means for absorbing the force on said top and bottom walls (26, 28) and seam (30) caused by flow of the liquid contained therein during movement of said reservoir (24) and venting means for venting volatiles from within said reservoir (24), said inertial flow control means including a supporting web disposed over and being in engagement with said reservoir (24) for absorbing forces occurring within said reservoir (24) when there is a sudden inertial shift in the liquid within said reservoir (24).

* * * * *